United States Patent [19]

Ito

[11] Patent Number: 4,632,600

[45] Date of Patent: Dec. 30, 1986

[54] MOVABLE FIXED-TYPE SEMI-SUBMERGED CONSTRUCTION

[75] Inventor: Soichi Ito, Tsu, Japan

[73] Assignee: Nippon Kokan Kabushiki Kaisha, Tokyo, Japan

[21] Appl. No.: 780,086

[22] Filed: Sep. 25, 1985

[51] Int. Cl.[4] ..... E02B 3/04; E02B 17/00

[52] U.S. Cl. ..... 405/30; 405/211; 405/216

[58] Field of Search ..... 405/30, 74, 211, 216, 405/31, 195, 203, 224

[56] References Cited

U.S. PATENT DOCUMENTS

| | | | |
|---|---|---|---|
| 3,248,886 | 5/1966 | Blenkarn | 405/211 |
| 3,453,830 | 7/1969 | Mitchell | 405/211 X |
| 3,686,887 | 8/1972 | Bruce | 405/211 X |
| 4,102,144 | 7/1978 | Anders | 405/211 |
| 4,142,819 | 3/1979 | Challine et al. | 405/211 X |

*Primary Examiner*—David H. Corbin

*Attorney, Agent, or Firm*—Fleit, Jacobson, Cohn & Price

[57] ABSTRACT

A movable fixed-type semi-submerged construction includes a plurality of legs each having a spat tank attached to its lower end and sunken to rest on the bottom of the sea and a superstructure supported on the legs. A scouring preventing structure including a cylindrical circumferential wall formed with a large number of holes therethrough is arranged at the lower part of each of the legs so as to encircle the spat tank.

4 Claims, 3 Drawing Figures

MOVABLE FIXED-TYPE SEMI-SUBMERGED CONSTRUCTION

BACKGROUND OF THE INVENTION

1. Field of the Invention

The present invention relates to a movable fixed-type semi-submerged construction adapted for exploiting undersea mineral resources such as petroleum or natural gas and more particularly to a structure for preventing and scouring by the tidal current of the sea bottom under each of the legs forming a part of the construction.

2. Description of the Prior Art

Movable fixed-type semi-submerged constructions heretofore used for exploiting undersea mineral resources such as petroleum or natural gas are of the type comprising usually three to four so-called legs forming a substructure and sunken to rest on the sea bottom and a superstructure arranged on the substructure and including living accommodations and drilling equipment. In this case, scouring by the tidal current of the sea bottom at the lower ends of the legs has a serious effect on the stability of the legs.

SUMMARY OF THE INVENTION

With a view to overcoming the foregoing deficiencies in the prior art, it is the primary object of the present invention to provide an improved movable fixed-type semi-submerged construction including a scouring preventing work or structure around its each leg so as to prevent scouring and eliminate apprehensions on the safety.

To accomplish the above object, the movable fixed-type semi-submerged construction of this invention includes a scouring preventing structure having a cylindrical circumferential wall with a large number of holes formed therethrough and arranged at the lower part of its each leg to encircle the outer side of a spat tank provided at the lower end of the leg.

Thus, the present invention is capable of preventing scouring of the sea bottom below and around the legs and thus its working has a great effect.

The above and other objects as well as advantageous features of the invention will become more clear from the following description taken in conjunction with the drawings.

DESCRIPTION OF THE PREFERRED EMBODIMENTS

An example of the prior art will now be described.

Figure 1:
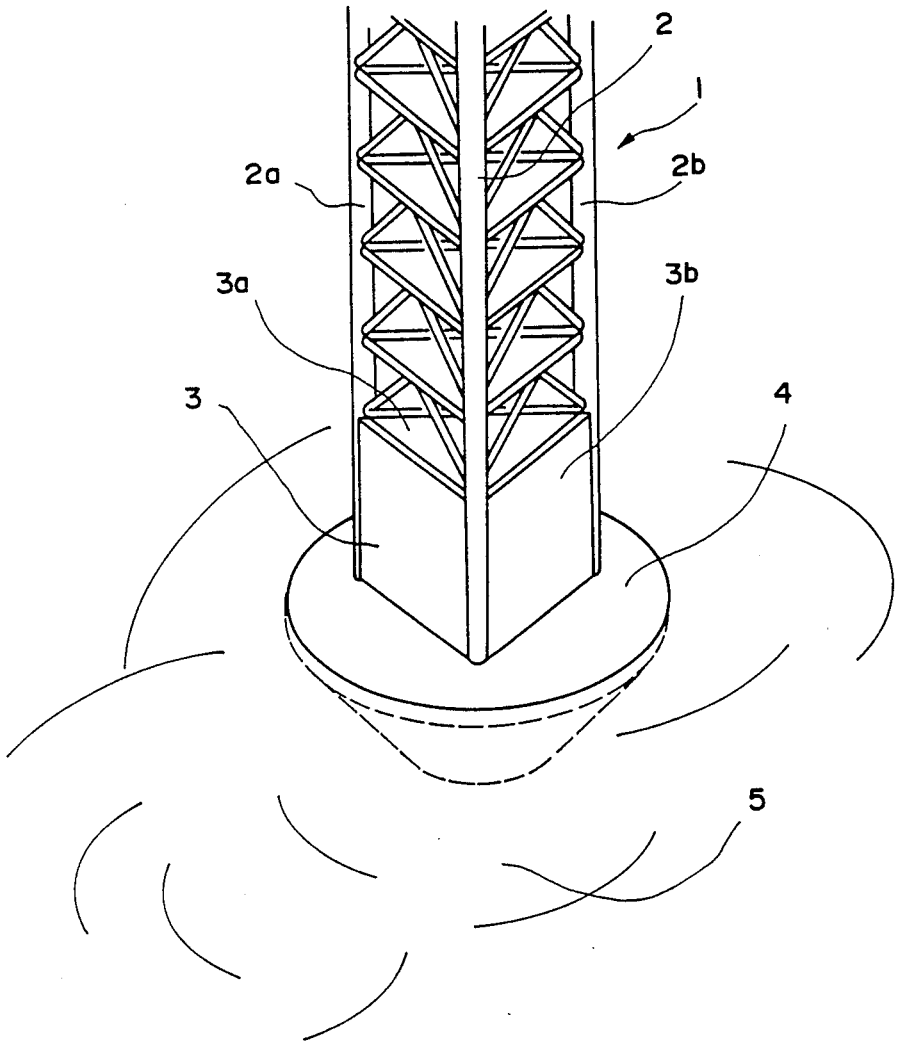
FIG. 1 is a perspective view showing the principal part of a conventional leg.

FIG. 1 is a perspective view showing the principal part of one leg of a conventional movable fixed-type semi-submerged construction. This leg 1 includes three posts 2, 2*a* and 2*b* which are connected in the form of a truss, plates 3, 3*a* and 3*b* fastened to the lower part of the truss and a spat tank 4 attached to the lower surfaces of the posts 2, 2*a* and 2*b* and the plates 3, 3*a* and 3*b* by welding or the like.

Three to four units of the leg 1 constructed in this way are sunken so that the spat tanks 4 are rested on the bottom of the sea and then a superstructure is built on the legs 1 at around the surface of the sea (alternatively, the substructure may be sunken to the bottom of the sea after the superstructure has been mounted on the legs). When the legs 1 are rested on the bottom of the sea in this way, the spat tanks 4 are mostly buried in the sand under the weight of the legs 1 themselves and the superstructure.

With the construction including the above-mentioned closed-type legs, there is a disadvantage from the safety point of view in that the plates 3, 3*a* and 3*b* provided at the lower part of each leg 1 resist the tidal current so that the sea bottom below and around the leg 1 is scoured and a large hole 5 is dug as shown in the Figure thus making the leg 1 unstable.

Figure 2:
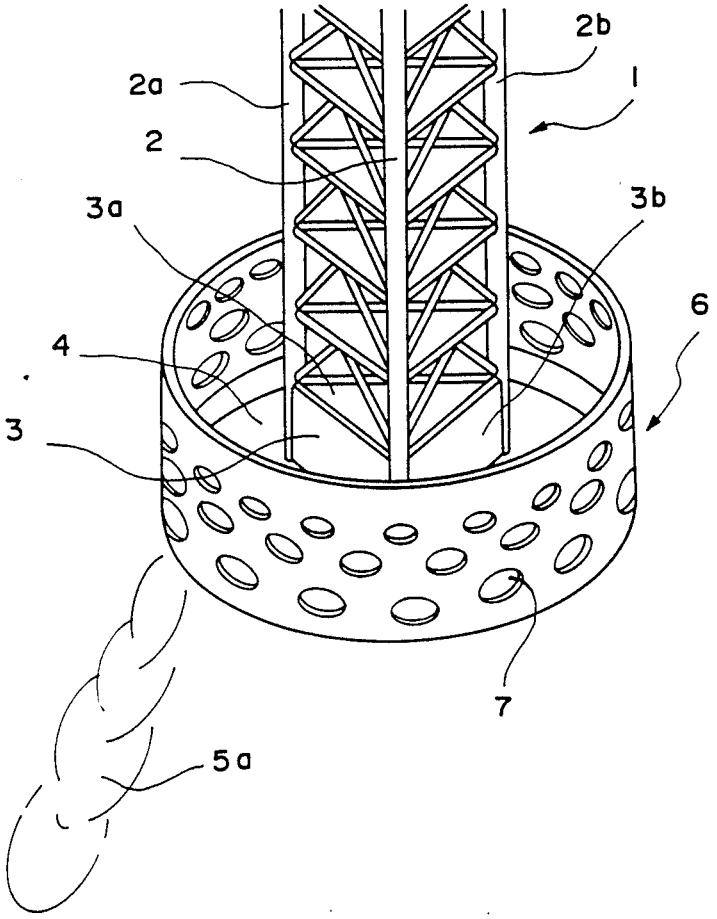
FIG. 2 is a perspective view showing the principal part of an embodiment of the invention.
Figure 3:
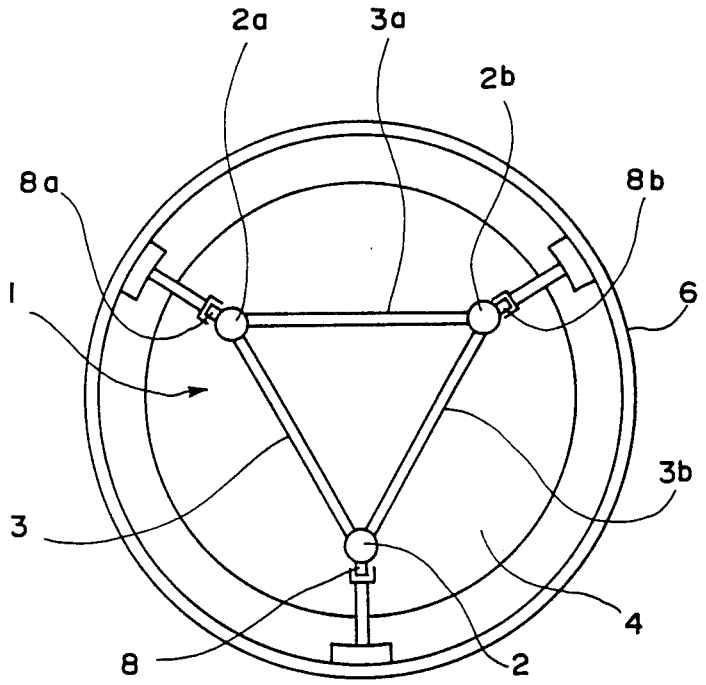
FIG. 3 is a plan view of FIG. 2.

FIG. 2 is a perspective view of an embodiment of the invention. In the Figure, the same or equivalent component parts as in FIG. 1 are designated by the same reference numerals and will not be described. Numeral 6 designates a scouring preventing structure including a cylindrical circumferential wall having an inner diameter equal to or slightly greater than the longest portion (usually about 10 m) of the spat tank 4 and formed with a large number of holes 7 therethrough and it is arranged to enclose the leg 1. The holes 7 should preferably be made so that those formed in the wall upper part are small in diameter and others located near the sea bottom are large in diameter in consideration of the flow velocity distribution at the boundary layer. Each scouring preventing structure 6 is for example mounted as shown in FIG. 3 so that it is vertically movable by a wire or the like along rails 8, 8*a* and 8*b* respectively arranged on the posts 2, 2*a* and 2*b*. Thus, the scouring preventing structure 6 is held in position above the spat tank 4 until the leg 1 is rested on the sea bottom and it is lowered when the leg 1 is rested on the bottom.

With the semi-submerged construction of the invention constructed as described above, the results of experiments have shown that by virtue of the large number of holes 7 formed through the circumferential wall of each scouring preventing structure 6, the tidal current flows through the holes 7 and no resistance is offered. In addition, the tidal current is divided into two portions one of which flows through the holes 7 and the other flows around the scouring preventing structure 6 thus reducing the flow velocity and also the fact that the holes 7 are divided into upper and lower holes of different diameters has the effect of reducing the formation of a horseshoe vortex which is said to be the main cause of scouring. The result is such that only a small scour 5*a* is made on the outer side of the scouring preventing structure 6 and there is no danger of a large hole being made around the leg 1 as in the case of the conventional construction.

While, in the embodiment described above, the circumferential wall of each scouring preventing structure is formed with the large number of round holes, the shape of the holes may take the form of any suitably selected shape such as square, diamond or oval shape and also the means for vertically moving each scouring preventing structure is not limited to the type illustrated but may be comprised of any one of various other mechanisms.

What is claimed is:

1. A movable fixed-type semi-submerged construction, said construction comprising a plurality of legs each including a plurality of posts connected in the form of a truss, the plurality of legs adapted to support a superstructure, a plurality of plates attached to lower parts of said posts, a spat tank mounted on lower ends of said posts, and a scouring preventing structure including a cylindrical circumferential wall formed with a number of holes therethrough, said cylindrical circumferential wall being arranged at a lower part of each of said legs so as to encircle an outer side of said spat tank, said holes formed in a lower part of each said circumferential wall being greater in diameter than said holes formed in an upper part of each said circumferential wall for lowering a flow velocity of water around said construction and for reducing formation of a horseshoe vortex to prevent scouring of the sea bottom below and around said legs.

2. A construction according to claim 1, wherein each said scouring preventing structure is supported on said posts so as to be vertically movable along said leg.

3. A construction according to claim 2, wherein a guide rail for enabling said scouring preventing structure to reciprocate freely is mounted on a side surface of each of said posts forming said legs.

4. A construction according to claim 1, wherein a diameter of said scouring preventing structure is greater than a diameter of said spat tank.

* * * * *